US005719011A

United States Patent [19]

Wolff

[11] Patent Number: 5,719,011

[45] Date of Patent: Feb. 17, 1998

[54] PHOTOGRAPHIC RECORDING MATERIAL

[75] Inventor: Erich Wolff, Solingen, Germany

[73] Assignee: Agfa-Gevaert AG, Germany

[21] Appl. No.: 731,083

[22] Filed: Oct. 9, 1996

[30] Foreign Application Priority Data

Oct. 18, 1995 [DE] Germany ..... 195 38 788.0

[51] Int. Cl.[6] ..... G03C 1/34; G03C 1/42; G03C 1/43; G03C 7/305

[52] U.S. Cl. ..... 430/445; 430/219; 430/222; 430/382; 430/405; 430/429; 430/443; 430/448; 430/543; 430/544; 430/559; 430/564; 430/566; 430/607; 430/955; 430/959; 430/957

[58] Field of Search ..... 430/219, 222, 430/544, 955, 959, 957, 543, 559, 564, 566, 607, 382, 405, 429, 448, 443, 445

[56] References Cited

U.S. PATENT DOCUMENTS

| | | | |
|---|---|---|---|
| 4,186,012 | 1/1980 | Odenwalder et al. | 430/544 |
| 4,690,885 | 9/1987 | Yagihara et al. | 430/219 |
| 4,734,353 | 3/1988 | Ono et al. | 430/219 |
| 4,994,363 | 2/1991 | Koya et al. | 430/959 |
| 5,116,717 | 5/1992 | Matsushita et al. | 430/219 |
| 5,354,650 | 10/1994 | Southby et al. | 430/222 |
| 5,455,141 | 10/1995 | Owczarczyk et al. | 430/222 |
| 5,500,338 | 3/1996 | Kerr et al. | 430/959 |

*Primary Examiner*—Richard L. Schilling
*Attorney, Agent, or Firm*—Connolly & Hutz

[57] ABSTRACT

Compounds of the formula I are suitable as release compounds for photographically useful groups (photographic units). On reacting with nucleophilic reagents, preferably with dinucleophiles, the photographically useful group is released.

(I)

In formula I:

PUG means a photographically useful group;

A means a strong electron acceptor;

V means a vinylene group or two or more successive vinylene groups, wherein the vinylene group or two successive vinylene groups may form part of an aromatic ring system;

L means one or more timing groups;

m means 0 (zero) 1 or 2;

n means 0 (zero), 1 or 2;

$R^1$ means H or methyl;

$R^2$ means H, alkyl with 1–18 C atoms or aryl;

$R^3$, $R^4$ mean H or an organic group, wherein $R^2$ and $R^3$ may also together mean the residue necessary to complete a ring.

8 Claims, 4 Drawing Sheets

PHOTOGRAPHIC RECORDING MATERIAL

BACKGROUND OF THE INVENTION

This invention relates to a novel photographic recording material which contains a photographic unit in capped form. The invention also relates to a photographic processing method in which the photographic unit is released from its capped form in an image-wise or uniform distribution.

A photographic unit should here be taken to mean any desired compound which may be used in a photographic material in order to achieve a certain result or a special effect. Such compounds include, for example,: couplers (colour couplers, masking couplers, white couplers), colour developers, dyes, development inhibitors, development accelerators, stabilisers, anti-oxidants, biocides, bleach accelerators, fixing agents.

There have in the past been many attempts to cap photographic units in some way such that they are initially present in an inactive or less active form and exert their full action only once "decapped". This has been performed, for example, to protect substances incorporated in the material from oxidation or from the action of harmful gases from the atmosphere, for example formaldehyde. The temporary capping was not removed until the processing stage and the unit was able to fulfil its intended purpose. A disadvantage of this was that there was frequently an inadequate differentiation between the capped and the free compound; i.e. either the capping was so stable that it was not cleaved even by small pH changes during processing, or the active substance was partially released under normal conditions, for example during long term storage under tropical conditions.

Examples of such protective groups are described, for example, in U.S. Pat. Nos. 4,690,885, 4,358,525, 4,554,243, 5,019,492. The search is thus still on for suitable capping methods for photographically useful compounds which do not have the above-stated disadvantages. Decapping may proceed here, for example, by pH change during processing or alternatively by means of a special reagent using the so-called "lock & key principle". This special reagent (for example a dinucleophile) here assumes the function of a selective decapping agent.

The present invention provides a photographic recording material having at least one photosensitive silver halide emulsion layer and optionally further, non-photosensitive layers, which material contains in at least one of its layers a compound of the formula I stated below. The present invention also provides a process for the production of a photographic image in which the stated recording material is developed in the presence of a dinucleophile.

The term "MCR=multiple coupling reagent" was first introduced into the chemical literature some 10 years ago by the authors D. Seebach and P. Knochel (c.f. *Tetrahedron*, volume 44, no. 14, pp 4495–4508 (1988); see also literature references 2 and 3 therein).

Further papers by other authors too on this topic:

2. D. Seebach and P. Knochel: *Helv. Chim. Acta* 67, 261 (1984)
3. D. Seebach and P. Knochel: *THL* 1981, 3223
4. D. Seebach and P. Knochel: *THL* 1982, 3897
5. D. Seebach and P. Knochel: *Nouveau Journ. de Chimie*, 5, 75 (1981)
6. D. Seebach and P. Knochel: *Synthesis*, 1982, 1017
7. D. J. Duncan, R. G. Lawton: *JACS*, 93, 2074 (1971)
8. McEuen, Nelson, Lawton: *J. Org. Chem.*, 35, 694 (1970)
9. Stetter, Raemsch, Elfert: *Ann.*, 1974, 1322
10. Eagan, Cromwell: *J. Org. Chem.*, 1974, 911

11. Eagan, Cromwell: *J. Org. Chem.*, 1974, 3863
12. Doomes, Clarke, Neitzel: *J. Org. Chem.*, 1987, 1540
13. Donalson, Saddler, Byrn: *J. Org. Chem.*, 1983, 2167
14. Saddler, Fuchs: *JACS*, 1981, 2112
15. Peters, v.d. Toorn, v. Bekkem: *Tetrahedron*, 1974, 633
16. Peters, v.d. Toorn, v. Bekkem: *Tetrahedron*, 1975, 2273.

An MCR is characterised by the following structural element

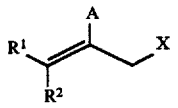

A here has the function of a suitable electron acceptor and X the function of a leaving group.

According to the above-stated literature, suitable nucleophiles (Nu) react in the following manner:

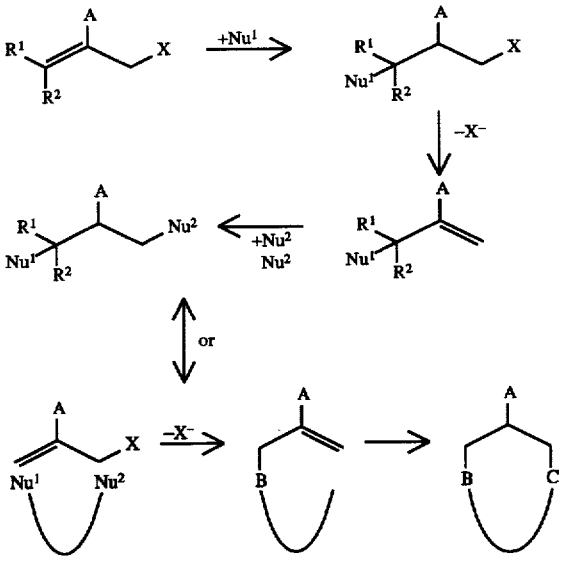

It has now been found that PUG's may effectively be capped using this general principle.

SUMMARY OF THE INVENTION

A suitable compound, which contains the PUG residue in capped form and from which the PUG residue may be released by reaction with an dinucleophile, accordingly has the following structure (formula I)

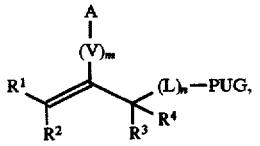

(I)

in which:

PUG means a photographically useful group;

A means a strong electron acceptor;

V means a vinylene group or two or more successive vinylene groups, wherein the vinylene group or two successive vinylene groups may form part of an aromatic ring system;

L means one or more timing groups;

m means 0 (zero), 1 or 2;

n means 0 (zero), 1 or 2;

$R^1$ means H or methyl;
$R^2$ means H, alkyl with 1–18 C atoms or aryl;
$R^3$, $R^4$ mean H or an organic group,
wherein $R^2$ and $R^3$ may also together mean the residue necessary to complete a ring.

DETAILED DESCRIPTION OF THE INVENTION

The photographically useful group denoted by PUG is, for example, $Br^-$, $Cl^-$, $I^-$, $SCN^-$ or a residue of a compound from one of the classes of compounds stated below: dyes, couplers, developers, electron transfer agents, development accelerators, development inhibitors, stabilisers, aft-oxidants, bleach accelerators, fixing agents. A dye denoted by PUG may a filter dye, a screening dye, a luminescent dye or a UV absorber; on release from the compound of the formula I, it may change its spectral absorption. A coupler denoted by PUG may, as a colour coupler, yield an image dye on reaction with a developer oxidation product (DOP) or, as a so-called white coupler, yield a substantially colourless coupling product; it may be colourless or, as a so-called masking coupler, have an intrinsic colour which it loses during the coupling reaction.

The photographically useful group denoted by PUG is attached to the C atom bearing residues $R^3$ and $R^4$ either directly (n=0) or by means of one or more timing groups or time control members denoted by L.

The activity of the electron acceptor denoted by A may be measured by its Hammett sigma value; substituents having sigma values of >0.3 are, for example, suitable. Examples of such substituents are: halogen, —CN, $—NO_2$, $—COOR^5$, $—CONR^5R^6$, $—COR^7$, $—PO(OR^5)_2$, $—SO_2$-alkyl, $—SO_2$-aryl, $—CF_3$, $—SO_2CF_3$, $—SO_2NR^5R^6$,

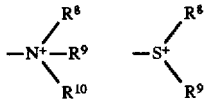

in which:
$R^5$ means alkyl or aryl;
$R^6$ means H or a residue as $R^5$;
$R^7$ means alkyl, aryl or a heterocyclic group;
$R^8$, $R^9$ and $R^{10}$ (mutually independently) mean residues as $R^5$.

Known timing groups or time control members are, for example a group

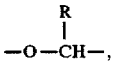

wherein the O atom is attached to a C atom of the releasing compound and the C atom to an N atom of a photographically useful group (for example DE-A-28 03 145), a group which, once released from the compound of the formula I, undergoes an intramolecular nucleophilic displacement reaction so releasing the photographically useful group (for example DE-A-28 55 697), a group in which, after release from the compound of the formula I, an electron transfer may occur along a conjugated system, by which means the photographically useful group is released (for example DE-A-31 05 026), or a group

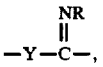

in which Y (for example —O—) is attached to the coupling site of a coupler and the C atom to an atom of the photographically useful group and in which R, for example, denotes aryl (for example EP-A-0 127 063). The time control member may also be a group which, once released, may itself enter into a coupling reaction or a redox reaction and, as a consequence of such a reaction, release the photographically useful group attached to it.

An organic group denoted by $R^3$ or $R^4$ is, for example and preferably, an alkyl group, for example methyl, ethyl, butyl or hexyl.

According to the above-stated literature, the claimed MCR may also be formed intermediately by a preceding reaction as shown below (LG=leaving group).

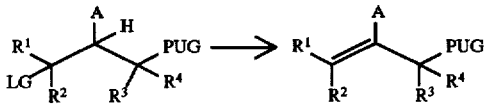

Examples of compounds of the formula I according to the invention are stated below.

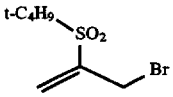

(1)

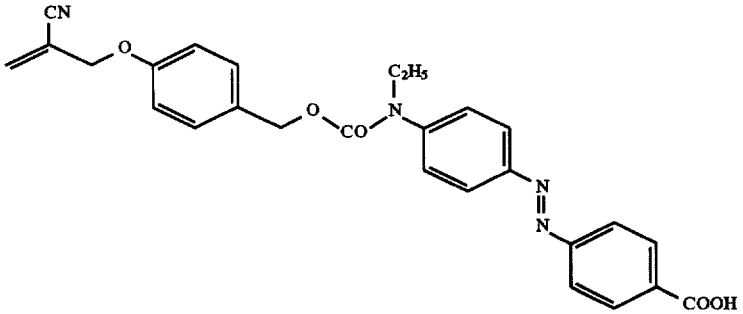

(2)

-continued
(3)
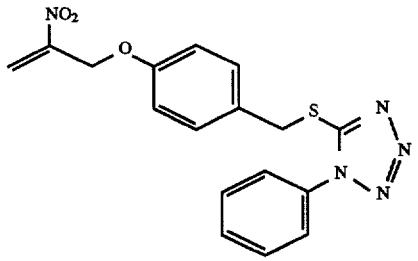
(4)
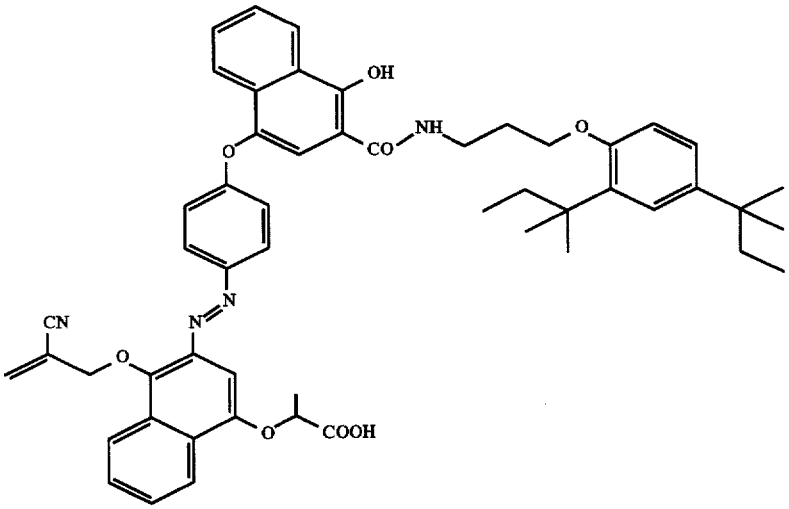
(5)
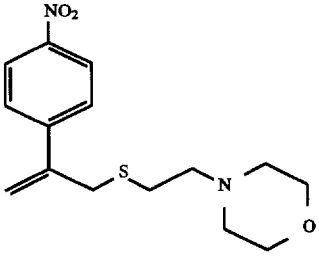
(6)
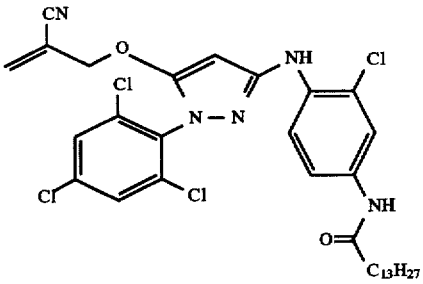
(7)
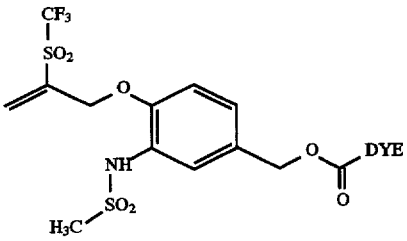
(8)
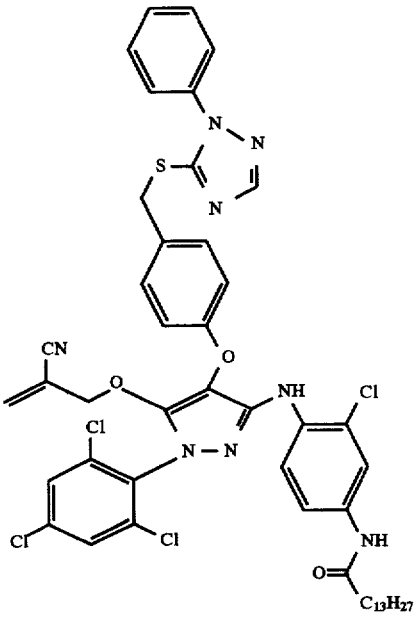

-continued
(9)
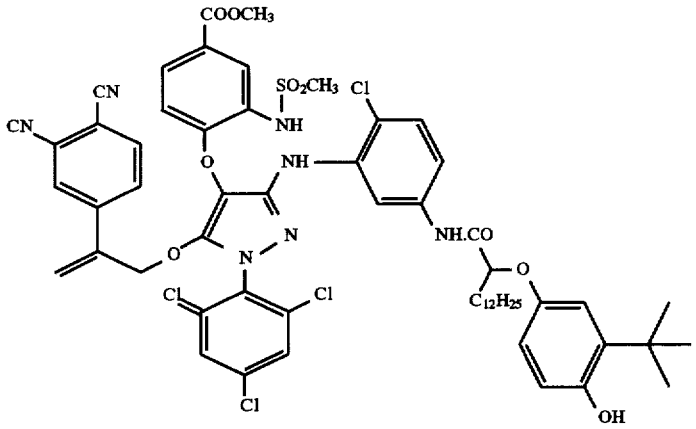
(10)
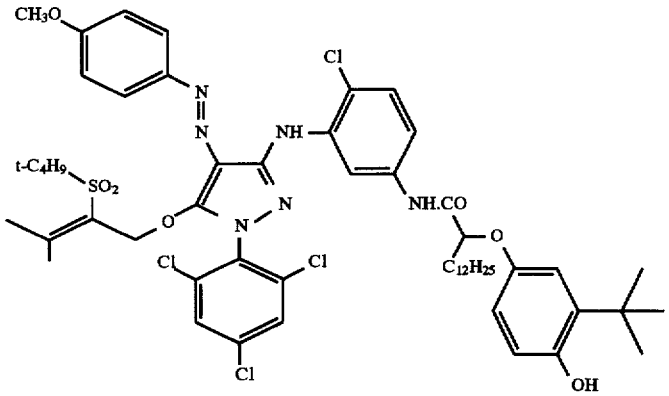
(11)
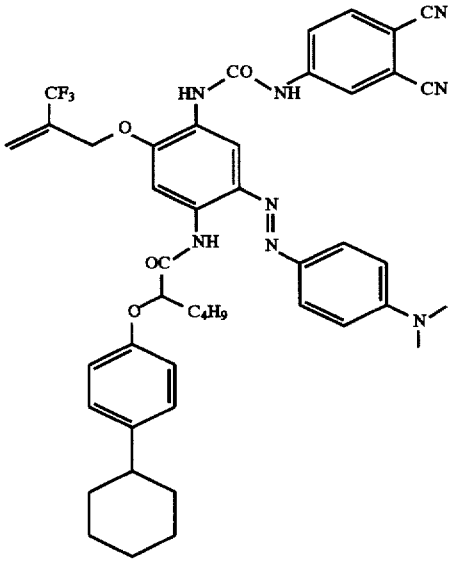
(12)
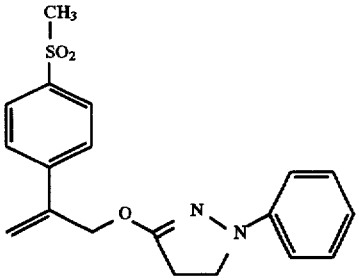

-continued
(13)
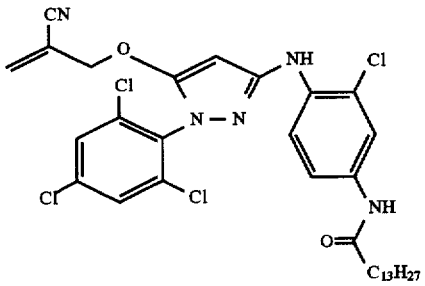
(14)
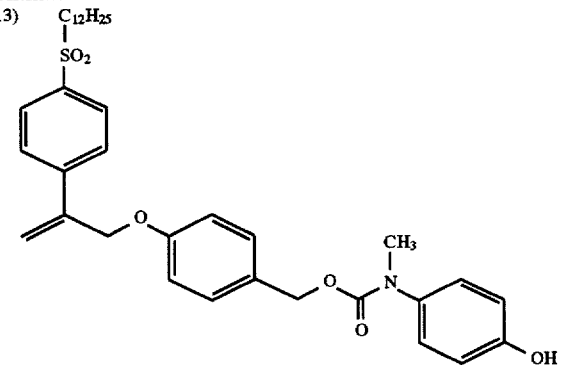
(15)
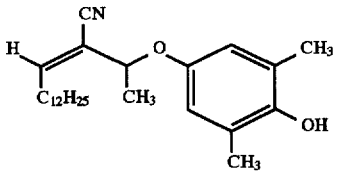
(16)
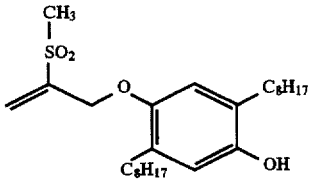
(17)
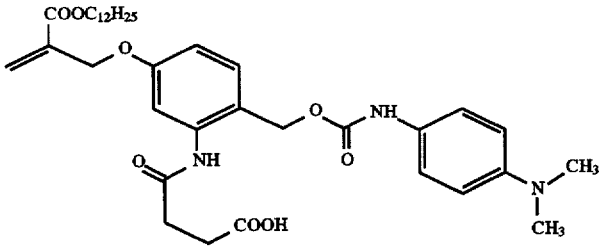
(18)
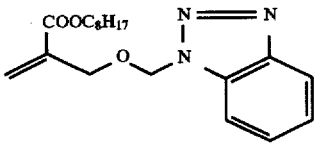
(19)
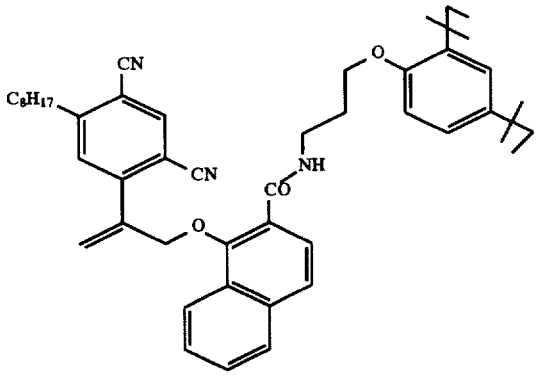
(20)
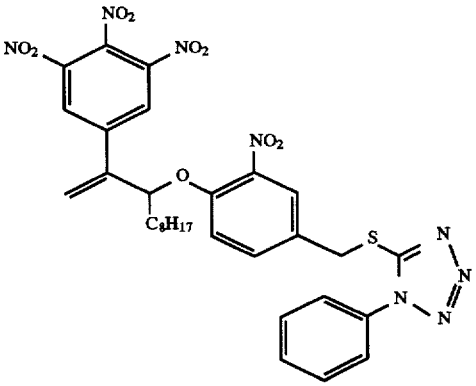
(21)
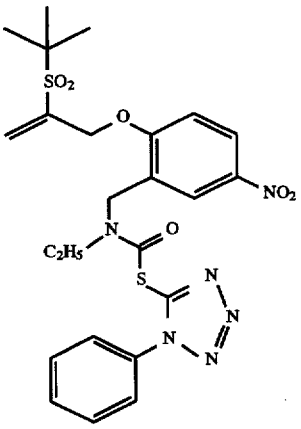

-continued
(22)
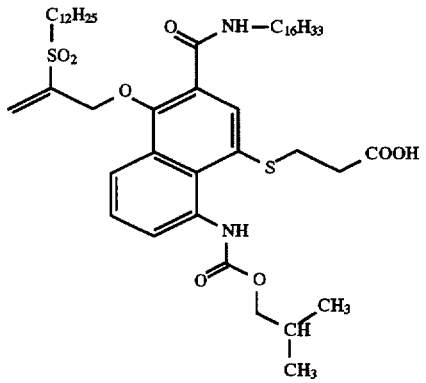
(23)
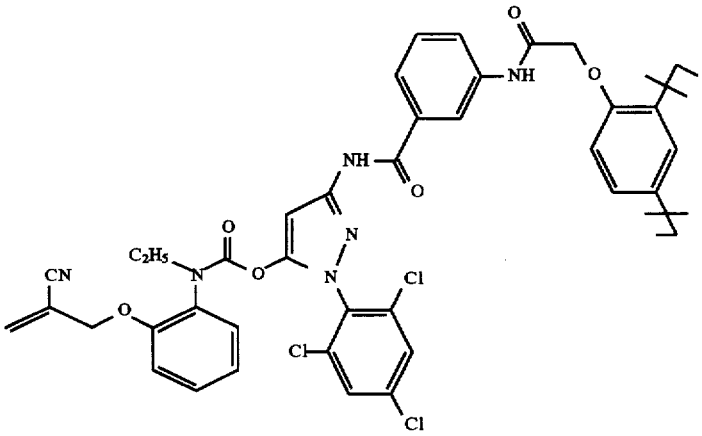
(24)
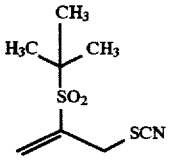
(25)
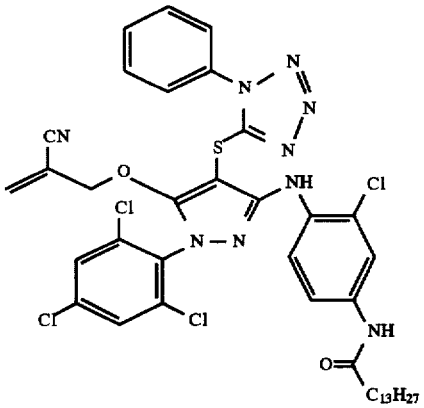

-continued
(26)
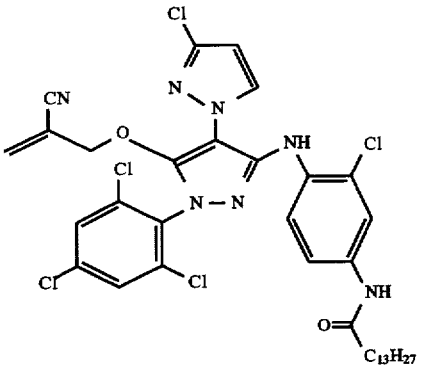
(27)
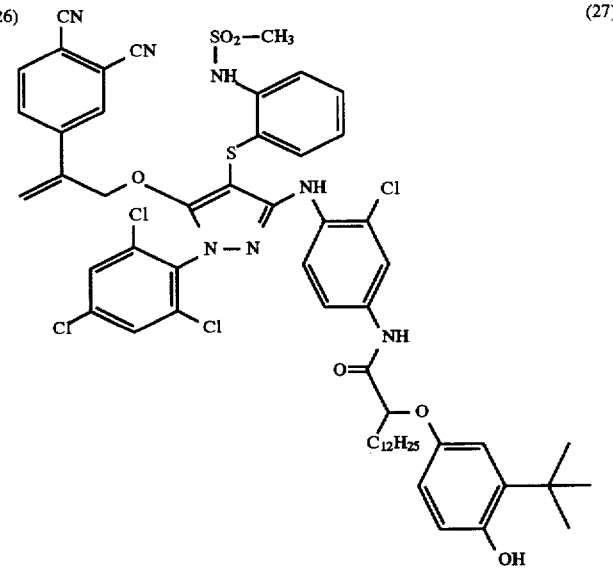
(28a)
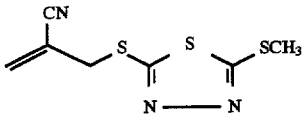
(28b)
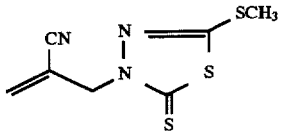
(29)
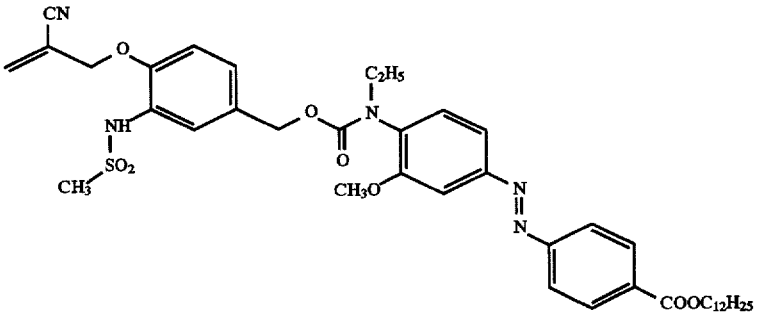
(30)
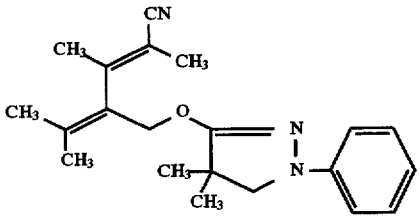
(31)
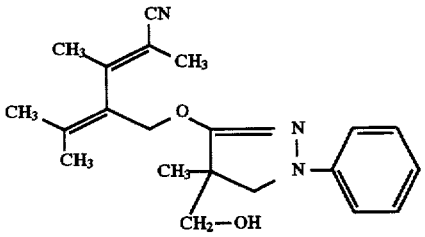
(32)
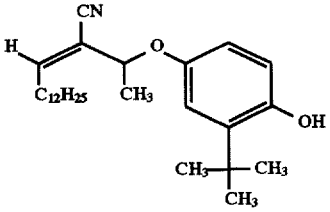

-continued
(33)
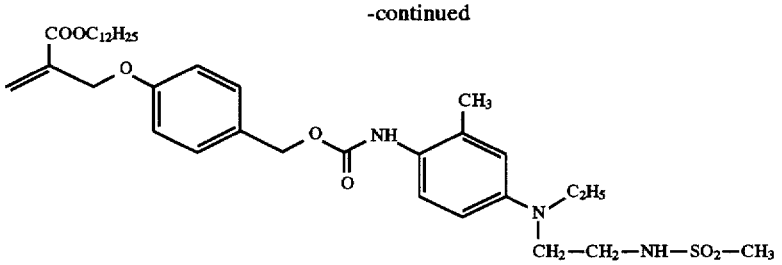
(34)
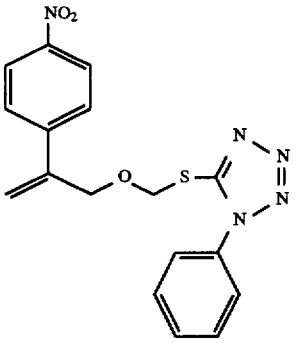
(35)
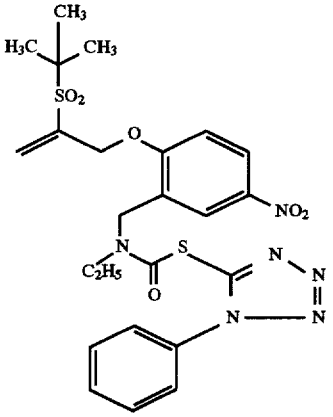
(36)
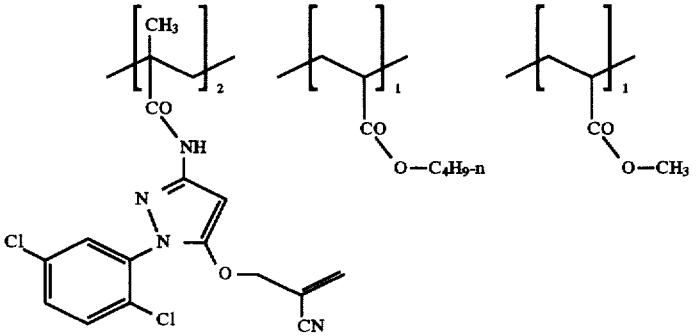
(37)
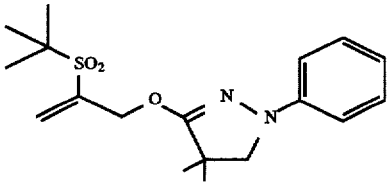
SYNTHESES
The compounds according to the invention may be synthesised using the following pathways known from the literature:
(1) K. Sato, O. Mujimoto: *J. Chem. Soc. Japan*, 1956, 77, 1409
C. J. M. Stirling: *J. Chem. Soc.*, 1964, 5856
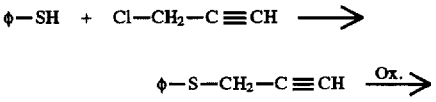
-continued
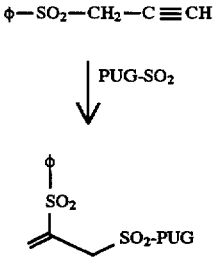

(2) E. Doomes, V. Clarke, I. Neitzel: *J. Org. Chem.*, 1987, 52, 1540–1543
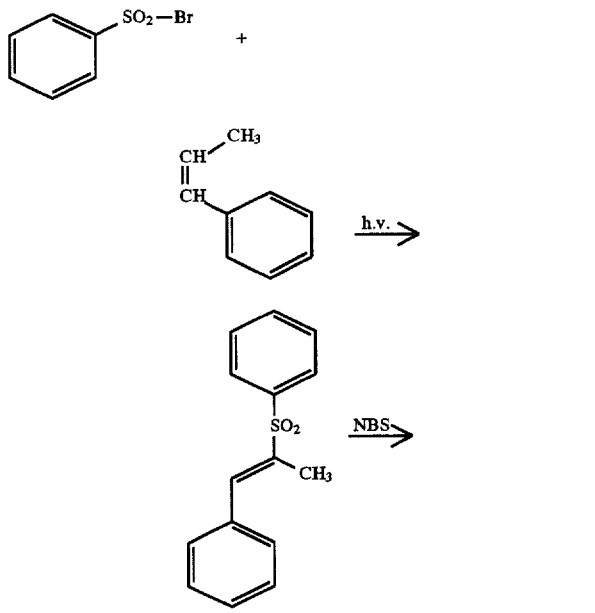
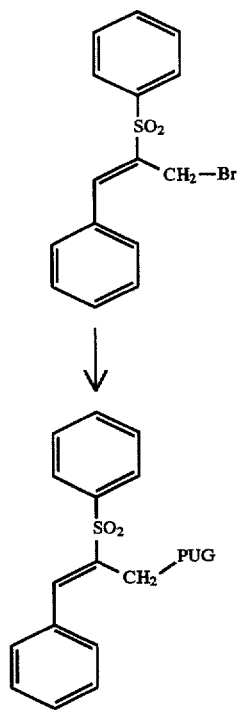
(3) E. Doomes, B. M. Overton: *J. Org. Chem.*, 1987, 52, 1544–48
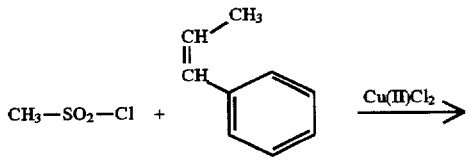
-continued
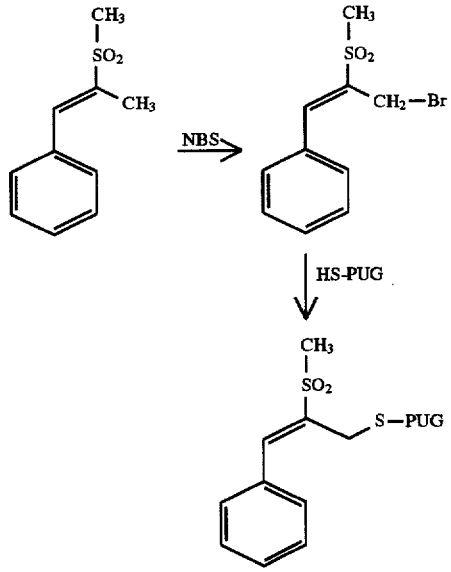
(4) D. S. Torbell, W. E. Lovett: *JACS*, 78, 2259 (1956)
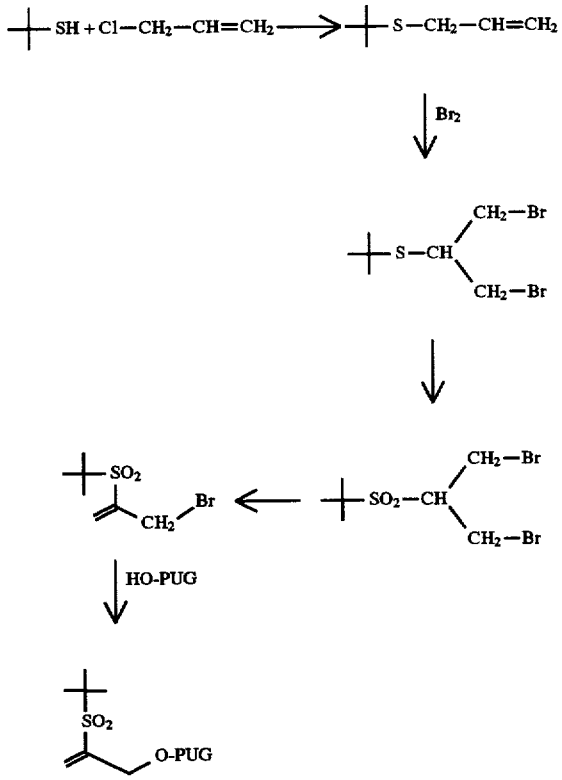
(5) J. Villieras, M. Rambaud: *Synthesis*, 1982, 924
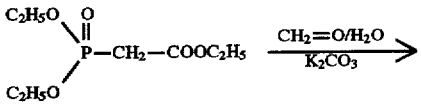

-continued
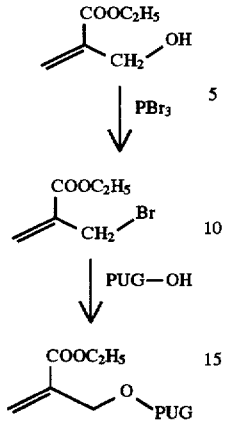
(6) N. E. Alami, Ch. Belaud, J. Villieras: *J. of Organometallic Chem.*, 348, 1–9 (1988)
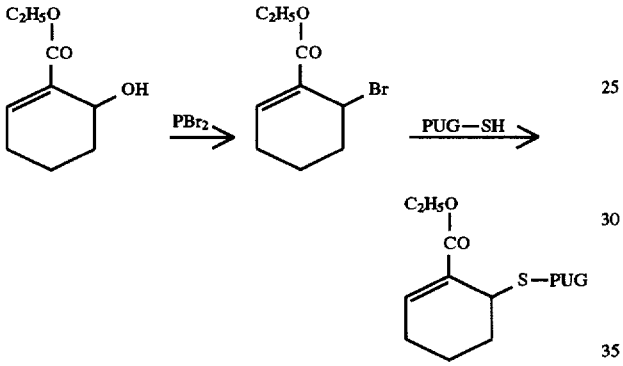
(7) D. Seebach and P. Knochel: Helv. Chim. Acta 67, 261 (1984) *Nouveau Journ. de Chim.* 5, 75 (1981)
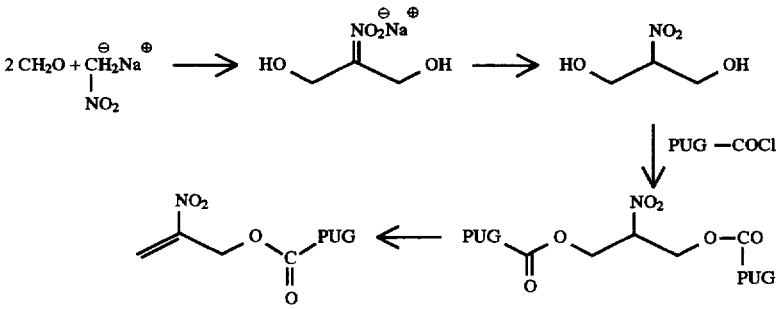
(8) Sumita Mitra and Richard G. Lawton *JACS:* 101, 11, 3097 (1979)

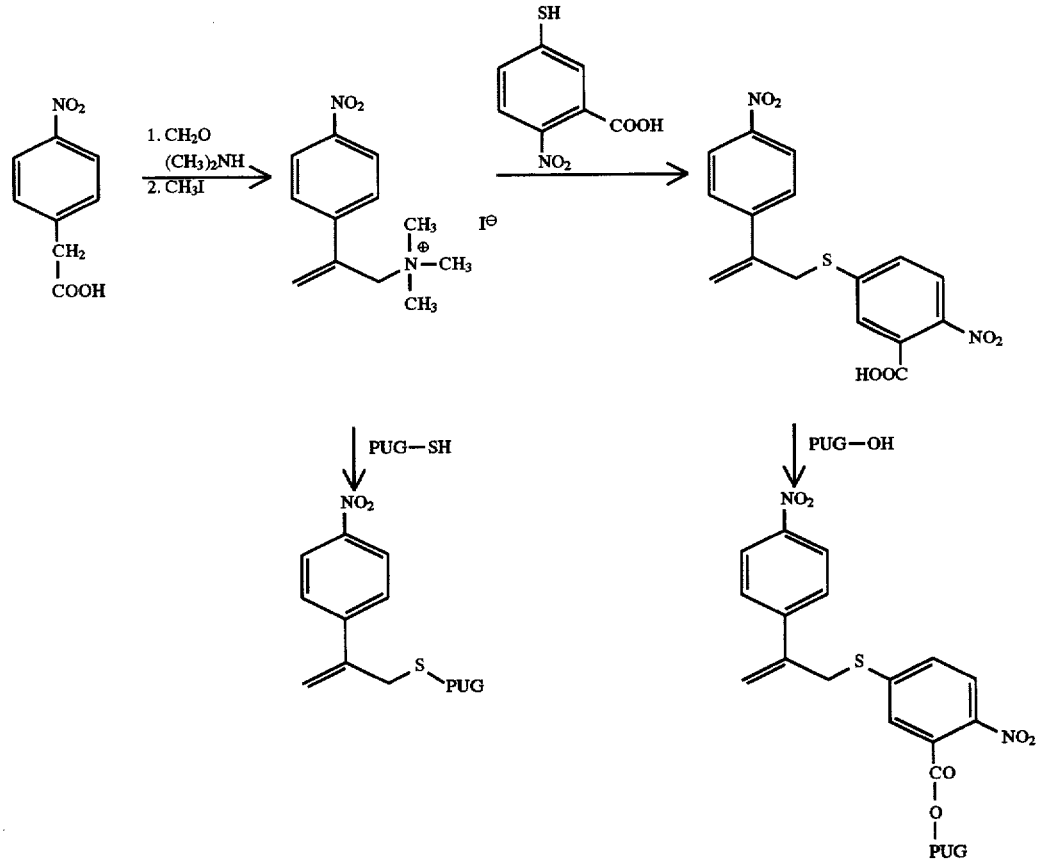

The compounds of the formula I used according to the invention are used in the conventional manner during production of the photographic recording material. Incorporation into a casting solution for a photographic layer is preferably performed as shortly as possible before casting. The quantity used is determined by the nature of the capped photographic unit. Anti-fogging agents and development inhibitors are used, for example, in a quantity of $10^{-8}$ to $10^{-1}$ mol per 1 mol of silver halide, developers in a quantity of $10^{-2}$ to 10 mol per 1 mol of silver halide, auxiliary developers (such as pyrazolidone derivatives) in a quantity of $10^{-4}$ to 10 mol per 1 mol of silver halide, fogging agents in a quantity of $10^{-6}$ to $10^{-2}$ mol per 1 mol of silver halide, silver salt solvents in a quantity of $10^{-3}$ to 100 mol per 1 mol of silver halide, bleach accelerators in a quantity of $10^{-5}$ to $10^{-1}$ mol per 1 mol of silver halide and dyes or colour formers in a quantity of $10^{-3}$ to 1 mol per 1 mol of silver halide.

The compounds of the formula I react with normal nucleophilic reagents, in particular with hydroxyl ions, so releasing the photographic unit, but this reaction proceeds relatively slowly.

It has been found that release proceeds very much faster if simple nucleophiles are not used, but instead compounds having at least two nucleophilic groups in an appropriate spatial arrangement, for example compounds of the formula II $$Nu^1—D—Nu^2 \qquad (II)$$

in which $Nu^1$ and $Nu^2$ mean nucleophilic groups, for example —OH, —SH, —NH—$R^5$ or =N—$R^5$;

$R^5$ means H, alkyl, acyl or alkylsulphonyl;

D means a chain with p atoms, in particular C atoms;

p means 0 (zero), 1, 2 or 3.

Such compounds are hereinafter referred to as dinucleophiles. Examples are:

| | |
|---|---|
| $H_2O_2$ | $CH_3$—NH—NH—$CH_3$ |
| $NH_2$—OH | $CH_3$—$SO_2$—NH—$NH_2$ |
| $NH_2$—$NH_2$ | $NH_2$—$CH_2$—CO—OH |
| $CH_3$—NH—OH | $NH_2$—$C(CH_3)_2$—$CH_2$—OH |
| $CH_3$—CO—NH—OH | |
| $CH_2$—$SO_2$—NH—OH | |
| $NH_2$—$CH_2$—$CH_2$—$NH_2$ | |
| $NH_2$—$CH_2$—$CH_2$—OH | |
| $NH_2$—$CH_2$—$CH_2$—SH | |

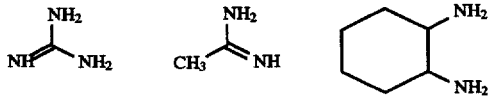

A suitable dinucleophile is, for example, added to a processing solution, for example to a developer solution. During processing, the capped photographically useful group (photographic unit) is released by the action of the dinucleophile on the compound of the formula I and is then capable of exercising its specific action. The concentration of the dinucleophile in the processing solution is determined by the particular circumstances, in particular by the nature of the dinucleophile, by the composition of the processing solution and the nature of the constituents thereof, by the nature of the photographically useful group (photographic unit) to be released and, not least, by the temperature and duration of action of the processing solution concerned. In a colour developer bath, the concentration of the dinucleophile is typically between $10^{-5}$ and 1 mol per 1 liter of solution. Depending upon the supply of dinucleophile, the photographic unit is released from the compounds of the formula I containing them. If the dinucleophile is supplied not in a uniform distribution, but in an image-wise distribution, which is, for example, the case if the dinucleophile is not contained in the processing solution, but is itself released in an image-wise distribution from a suitable precursor compound as a consequence of photographic development, then the photographically useful group contained in the compounds of the formula I may also be produced in an image-wise distribution.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 cyan-sensitive, yellow-coupling silver halide emulsion layers. The layers of identical spectral sensitivity differ with regard to their photographic sensitivity, wherein the less sensitive partial layers are generally arranged closer to the support than the more highly sensitive partial layers.

A yellow filter layer is conventionally located between the green-sensitive and blue-sensitive layers to prevent blue light from reaching the underlying layers.

Possible options for different layer arrangements and the effects thereof on photographic properties are described in *J. Int. Rec. Mats.*, 1994, volume 22, pages 183–193.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE 25 30 645).

The substantial constituents of the photographic emulsion layers are binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Photographic materials with camera sensitivity conventionally contain silver bromide-iodide emulsions, which may optionally also contain small proportions of silver chloride. Photographic print materials contain either silver chloride-bromide emulsions with up to 80 wt. % of AgBr or silver chloride-bromide emulsions with above 95 mol. % of AgCl.

Details relating to colour couplers may be found in *Research Disclosure* 37254, part 4 (1995), page 288 and in *Research Disclosure* 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 μm in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical whiteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in Research Disclosure 37254, part 8 (1995), page 292 and in Research Disclosure 37038, parts IV, V, VI, VII, X, XI and XIII (1995), pages 84 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 et seq. together with example materials.

EXAMPLE 1

Model tests were performed which prove the accelerated cleavage by dinucleophiles.

Compound 1

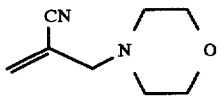

with equivalent quantities of $OH^{\ominus}$ at pH 10 eliminates virtually no morpholine within 3 to 4 hours with (GC detection).

If equivalent quantities of hydroxylamine are added, 90% morpholine is formed within 4 to 5 minutes.

EXAMPLE 2

The compound according to the invention of the formula

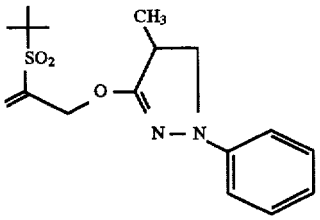

was dissolved in a Britton-Robinson buffer at pH=11 and 38° C.

Figure 1:
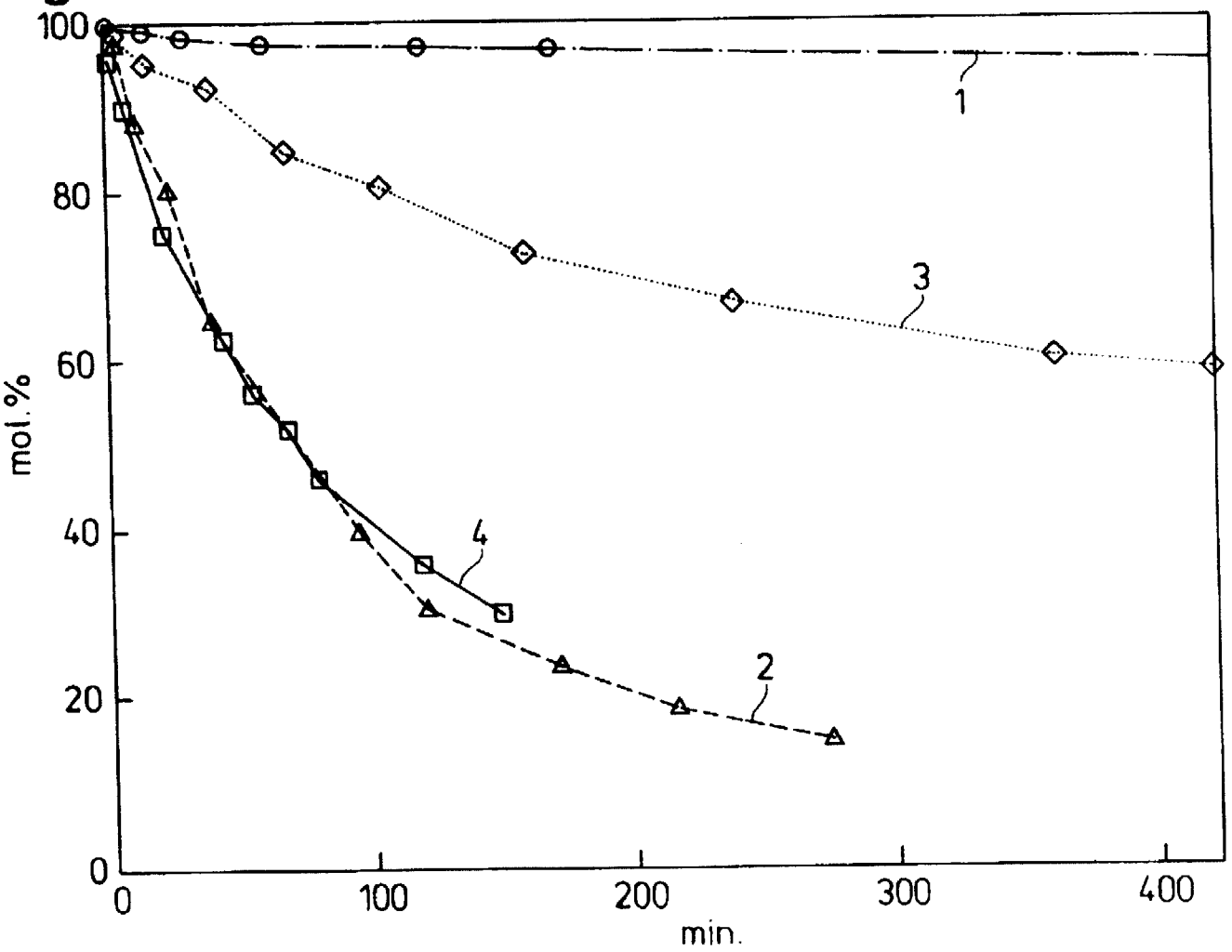
FIGS. 1–4 show release rates in following Examples 2–5.

After addition of hydroxylamine, hydrazine and hydrogen peroxide, the decrease in the starting compound was monitored over time by HPLC. FIG. 1 shows the profile over time:

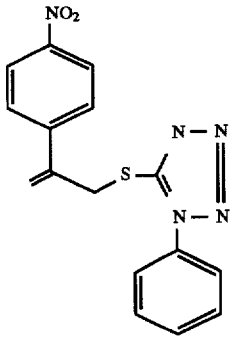

EXAMPLE 3

The compound of the formula

Figure 2:
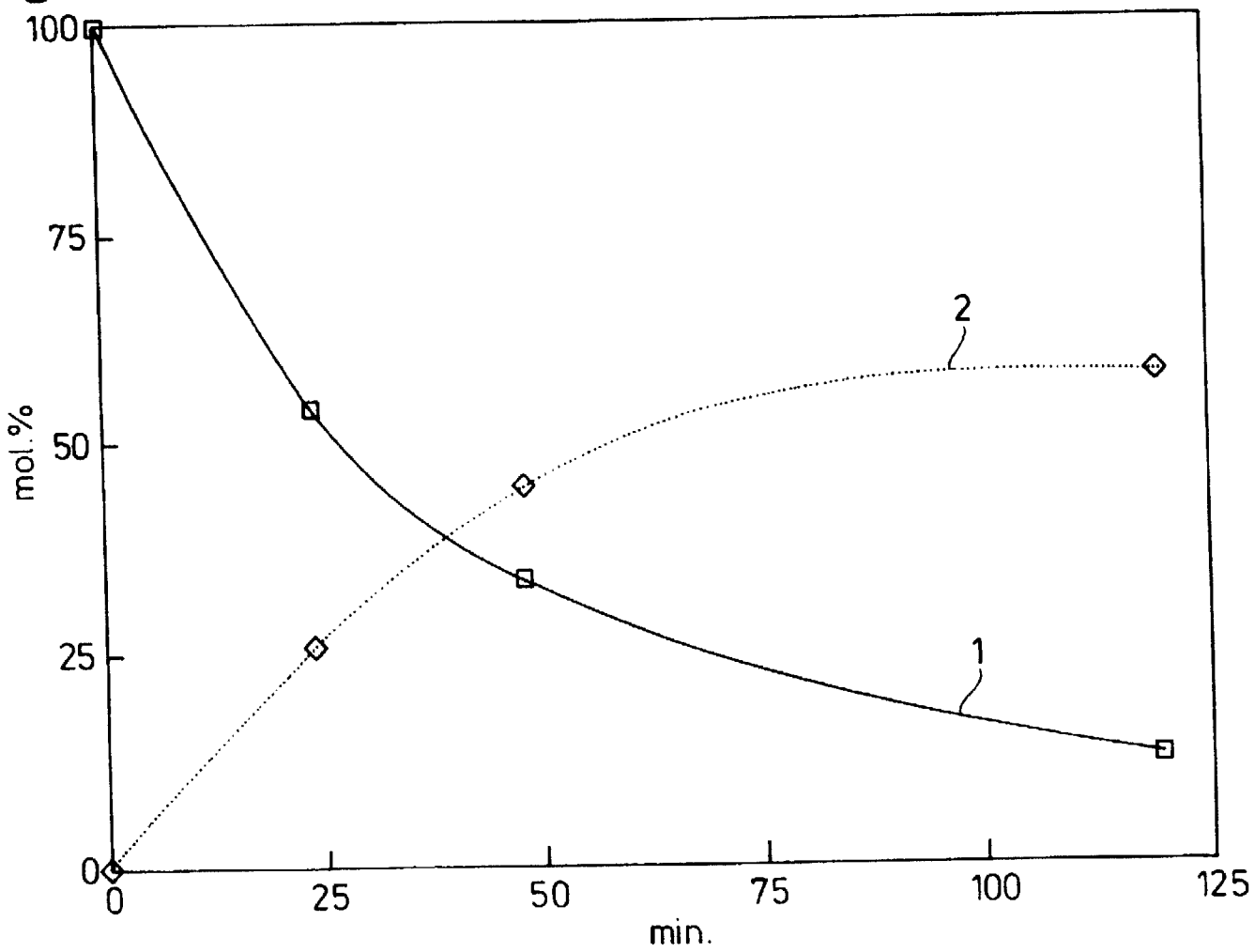

| | |
|---|---|
| Curve 1 | only pH 11, no additions |
| Curve 2 | addition of hydroxylamine |
| Curve 3 | addition of hydrazine |
| Curve 4 | addition of hydrogen peroxide |

was dissolved in a Britton-Robinson buffer at pH=11 and 38° C. After the addition of equivalent quantities of hydrazine, the decrease in concentration of the introduced compound and the increase in phenylmercaptotetrazole was monitored over time by HPLC. FIG. 2 shows the profile over time:

| | |
|---|---|
| Curve 1 | concentration of the introduced compound |
| Curve 2 | concentration of phenylmercaptotetrazole |

EXAMPLE 4

Figure 3:
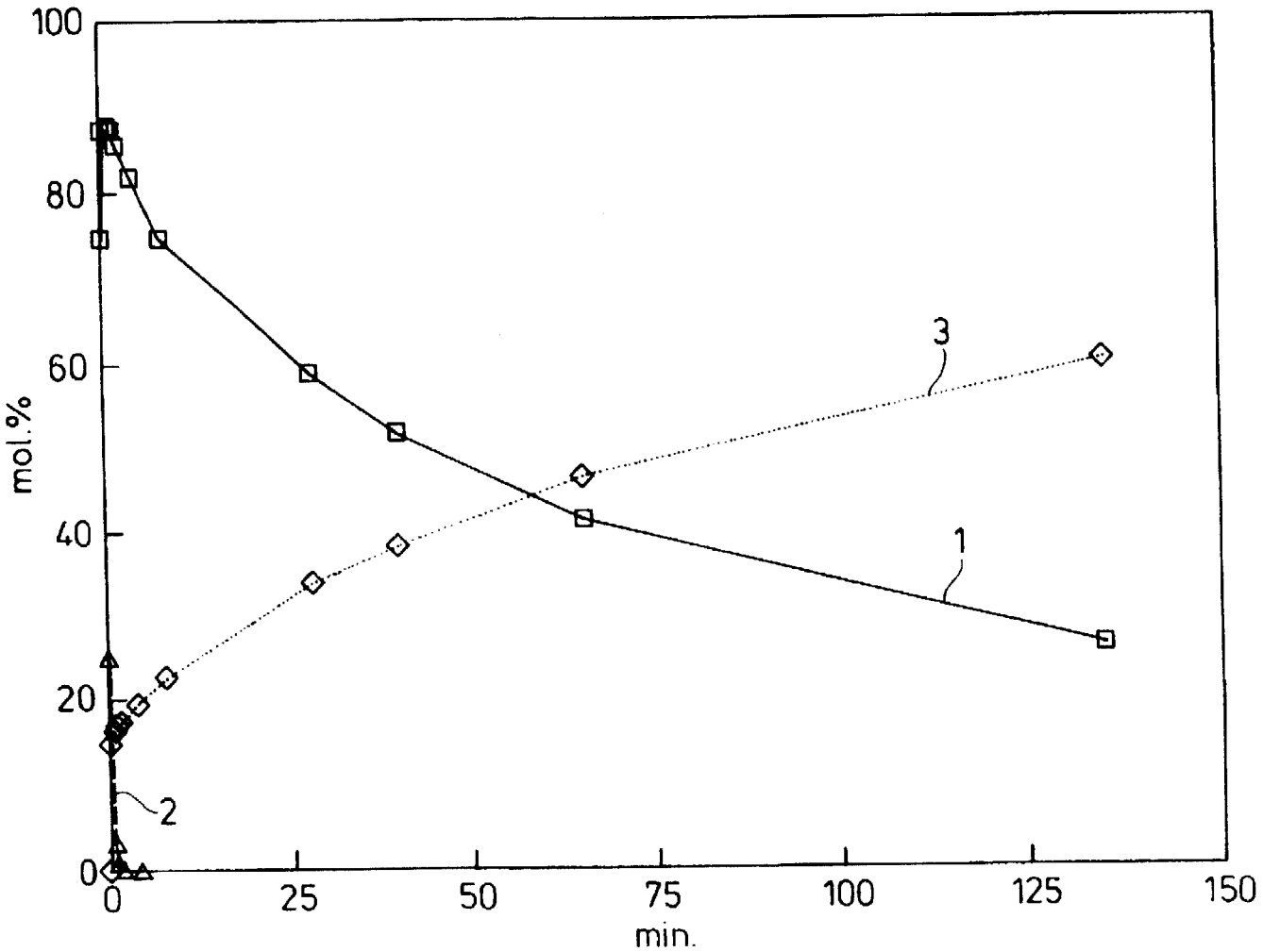

According to HPLC analysis, compound 28 consists of 25% isomer 28A and 75% isomer 28B. After addition of Britton-Robinson buffer pH=11 and hydrazine, 2-mercapto-5-methylthio-1,3,4-thiadiazole (THIADIAZOLE) is released at 20° C. The decrease in compound 28 (isomers 28A and 28B) and the formation of THIDIAZOLE are monitored by HPLC. FIG. 3 shows the profile over time:

| | |
|---|---|
| Curve 1 | isomer 28A |
| Curve 2 | isomer 28B |
| Curve 3 | THIADIAZOLE |

Isomer 28A is obviously cleaved very much more rapidly than isomer 28B.

EXAMPLE 5

The compound of the formula

Figure 4:
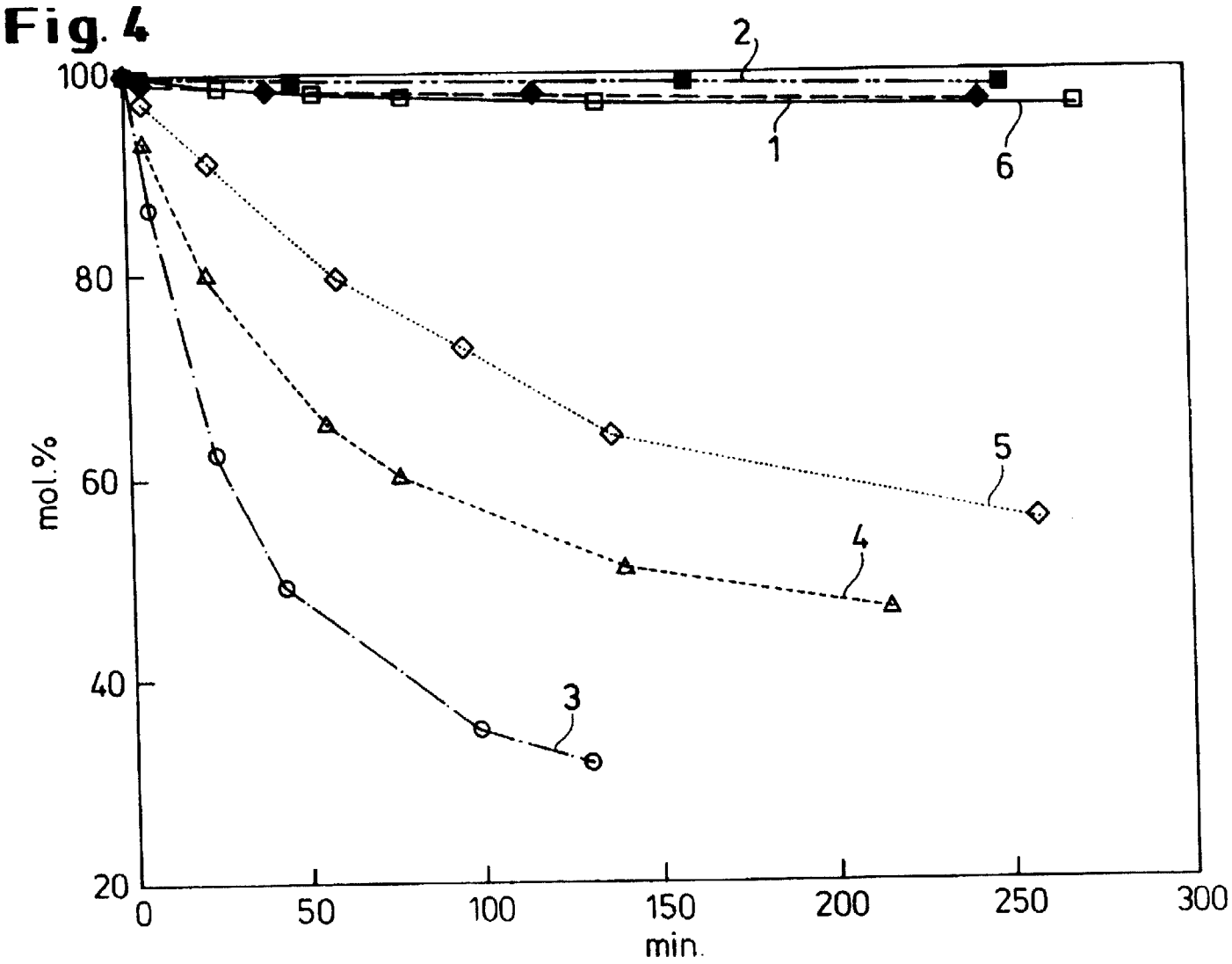

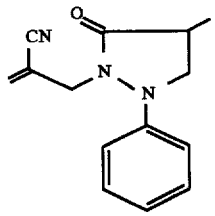

was dissolved at pH=11 and 38° C. in a Britton-Robinson buffer. FIG. 4 shows the profile over time of the decrease in the stated compound after the addition of

| | |
|---|---|
| pyrazole | (curve 1) |
| methylhydroxylamine | (curve 2) |
| hydroxylamine | (curve 3) |
| hydrazine | (curve 4) |
| hydrogen peroxide | (curve 5) |
| and no addition | (curve 6) |

The stated compound is largely stable with regard to $OH^-$, methylhydroxylamine and pyrazole. A new HPLC peak is obtained with hydroxylamine, hydrazine and $H_2O_2$, which may be assigned to the oxidation product of the released Phenidone Z.

EXAMPLE 6

A colour photographic recording material was produced by applying the following layer onto a transparent cellulose triacetate layer support. The stated quantities relate in each case to 1 $m^2$. The applied quantity of silver halide is stated as the corresponding quantity of $AgNO_3$. Stabilisation was provided with 0.1 g of 4-hydroxy-6-methyl-1,3,3a,7-tetraazaindene per 100 g of $AgNO_3$.

Sample 1

0.700 g of $AgNO_3$ (as red-sensitised AgBrI emulsion)

1.200 g of gelatine 0.970 g of cyan coupler of the formula

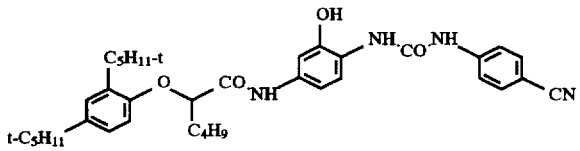

0.2 mmol of compound 37 according to the invention 1000 mg of dibutyl phthalate

Sample 2 contained 0.4 mmol of compound 37

Sample 3 contained 0.6 mmol of compound 37

Sample 4—no addition of compound 37.

All samples were provided with a protective topcoat of a 3% gelatine solution containing the compound of the formula

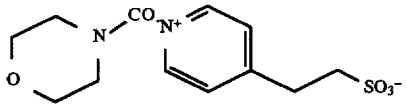

as hardener.

After drying and cutting to size, the resultant samples were exposed behind a step wedge and processed using the negative AP 70 process (38° C.).

| Bath | min |
|---|---|
| Colour developer | 3.25 |
| Bleaching bath | 6.5 |
| Rinsing | 3.0 |
| Fixing bath | 6.5 |
| Rinsing | 6.0 |

The following baths were used:

Colour developer

| | |
|---|---|
| 8000 ml | water |
| 17 g | hydroxyethanediphosphonic acid, Na |
| 12 g | ethylenediaminetetraacetic acid (EDTA acid) |
| 47 g | 1-(N-ethyl-N-hydroxyethyl)-3-methyl-p-phenylenediamine |
| 25 g | hydroxylammonium sulphate |
| 39 g | sodium sulphite |
| 15.5 g | sodium hydrogen carbonate |
| 335 g | potassium carbonate |
| 13.5 g | potassium bromide |
| | make up to 10 l with water; pH 10.0 |

Bleaching bath

| | |
|---|---|
| 8000 ml | water |
| 1390 g | ammonium bromide |
| 865 g | EDTA $NH_4$-Fe |
| 163 g | EDTA acid |
| 100 g | ammonia |
| | make up to 10 l with water and adjust to pH 6.0 ± 0.1 with approximately 15 ml of glacial acetic acid. |

Fixing bath

| | |
|---|---|
| 8000 ml | water |
| 1500 g | ammonium bromide |
| 100 g | sodium sulphite |
| 20 g | sodium hexametaphosphate |
| | make up to 10 l with water; pH 7.5 |

Key:

| | |
|---|---|
| E | sensitivity in DIN units |
| γ | gradient of linear section of characteristic curve |
| FA | colour yield in $D_{max}$/applied Ag |
| S | fog |
| $D_{max}$ | maximum density |

| | S | γ | E | $D_{max}$ | FA |
|---|---|---|---|---|---|
| Sample 1 | 0.08 | 3.3 | 102 | 2.42 | 3.46 |
| Sample 2 | 0.07 | 3.3 | 105 | 2.44 | 3.48 |
| Sample 3 | 0.07 | 3.2 | 105 | 2.44 | 3.48 |
| Sample 4 | 0.07 | 3.4 | 100 | 2.40 | 3.43 |

Development as described but without hydroxylamine sulphate in developer.

| | | | | | |
|---|---|---|---|---|---|
| Sample 1 | 0.08 | 3.4 | 100 | 2.40 | 3.43 |
| Sample 2 | 0.08 | 3.4 | 100 | 2.40 | 3.43 |
| Sample 3 | 0.08 | 3.4 | 101 | 2.40 | 3.43 |
| Sample 4 | 0.07 | 3.4 | 100 | 2.40 | 3.43 |

It is clear from the two tables that, when the capped electron transfer agent is present, this may be released by hydroxylamine, which in particular results in an increase in sensitivity.

I claim:

1. The photographic recording material which comprises at least one silver halide emulsion layer and optionally further layers arranged on a layer support, which material contains in at least one of its layers a photographically useful group (PUG) in capped form, and said photographically useful group is in the form of a compound of the following formula

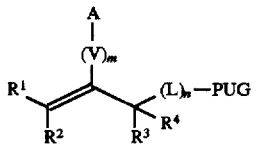

(I)

in which

PUG means a photographically useful group;

A means a strong electron acceptor having a Hammett sigma value of >0.3;

V means a vinylene group or two or more successive vinylene groups, wherein the vinylene group or two successive vinylene groups may form part of an aromatic ring system;

L means one or more timing groups;

m means 0 (zero), 1 or 2;

n means 0 (zero), 1 or 2;

$R^1$ means H or methyl;

$R^2$ means H, alkyl with 1–18 carbon atoms or an unsubstituted phenyl;

$R^3$ and $R^4$ are identical or different and mean H or an organic group, wherein $R^2$ end $R^3$ may also together mean the residue necessary to complete a ring.

2. The recording material according to claim 1, wherein A denotes halogen or one of the following groups:

$-CN$, $-NO_2$, $-COOR^5$, $-CONR^5R^6$, $-COR^7$, $-PO(OR^5)_2$, $-SO_2$-alkyl, $-SO_2$-aryl, $-CF_3$, $-SO_2CF_3$, $-SO_2NR^5R^6$,

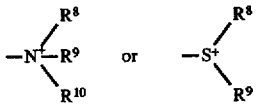

in which:

$R^5$ means alkyl or aryl;

$R^6$ means H or a residue as $R^5$;

$R^7$ means alkyl, aryl or a heterocyclic group;

$R^8$, $R^9$ and $R^{10}$ are identical or different and mean alkyl or aryl.

3. The recording material according to claim 1, wherein PUG is the residue of a dye, a coupler, a developer, an electron transfer agent, a development accelerator, a development inhibitor, a stabilizer, an anti-oxidant, a bleach accelerator or a fixing agent.

4. A process for the production of a photographic image by development of a photographic recording material having at least one silver halide emulsion layer in the presence of a dinucleophile, which comprises exposing to light and developing a photographic recording material according to claim 1, in the presence of a compound of the formula $Nu^1$—D—$Nu^2$ (II), in which:

$Nu^1$ and $NU^2$ are identical or different and mean —OH, —SH, —NH—$R^5$ or =N—$R^5$;

$R^5$ means H, alkyl, acyl or alkylsulphonyl;

D means a chain with p atoms;

p means 0 (zero), 1, 2 or 3.

5. The process according to claim 4, wherein the compound of the formula II is contained in the developer.

6. The photographic recording material according to claim 1, wherein PUG is $Br^-$, $Cl^-$, $I^-$, or $SCN^-$.

7. The process according to claim 5, wherein

A denotes halogen or one of the following groups:

$-CN$, $-NO_2$, $-COOR^5$, $-CONR^5R^6$, $-COR^7$, $-PO(OR^5)_2$, $-SO_2$-alkyl, $-SO_2$-aryl, $-CF_3$, $-SO_2CF_3$, $-SO_2NR^5R^6$,

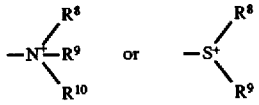

in which:

$R^5$means alkyl or aryl;

$R^6$ means H or a residue as $R^5$;

$R^7$ means alkyl, aryl or a heterocyclic group;

$R^8$, $R^9$ and $R^{10}$ are identical or different and mean alkyl or aryl.

8. The process according to claim 7, wherein PUG is $Br^-$, $Cl^-$, $I^-$, or $SCN^-$.

* * * * *